US012782021B2

(12) United States Patent
Sakarwala

(10) Patent No.: US 12,782,021 B2
(45) Date of Patent: Nov. 3, 2026

(54) SYSTEMS AND METHODS FOR FLASH TANK LIQUID LEVEL CONTROL

(71) Applicant: Rheem Manufacturing Company, Atlanta, GA (US)

(72) Inventor: Ammar Khuzeima Sakarwala, Lewisville, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 120 days.

(21) Appl. No.: 18/824,274

(22) Filed: Sep. 4, 2024

(65) Prior Publication Data

US 2025/0085039 A1 Mar. 13, 2025

Related U.S. Application Data

(60) Provisional application No. 63/581,109, filed on Sep. 7, 2023.

(51) Int. Cl.
*F25B 49/02* (2006.01)
*F25B 41/31* (2021.01)

(52) U.S. Cl.
CPC ..... *F25B 49/02* (2013.01); *F25B 41/31* (2021.01); *F25B 2600/05* (2013.01); *F25B 2600/2513* (2013.01); *F25B 2700/04* (2013.01); *F25B 2700/19* (2013.01)

(58) Field of Classification Search
CPC ..... F25B 49/02; F25B 41/31; F25B 41/39; F25B 2400/23; F25B 2600/05; F25B 2600/2513; F25B 2700/04; F25B 2700/19
See application file for complete search history.

(56) References Cited

U.S. PATENT DOCUMENTS

| | | | | |
|---|---|---|---|---|
| 6,044,655 | A * | 4/2000 | Ozaki | F25B 40/00 62/502 |
| 7,891,201 | B1 * | 2/2011 | Bush | F25B 9/008 62/115 |
| 8,205,464 | B2 * | 6/2012 | Kasahara | F25B 9/008 62/208 |
| 9,803,897 | B2 * | 10/2017 | Furui | F25B 30/02 |
| 11,959,676 | B2 * | 4/2024 | Prins | F25B 49/02 |
| 2010/0115975 | A1 * | 5/2010 | Mitra | F25B 1/10 700/282 |

(Continued)

*Primary Examiner* — Marc E Norman
(74) *Attorney, Agent, or Firm* — Eversheds Sutherland (US) LLP

(57) ABSTRACT

Systems and methods for flash tank liquid level control are provided. A flash tank is a device used to separate the vapor and liquid phases of a mixture. Maintaining a desired liquid level may be important. If the flash tank overflows, liquid injected into the compressor may potentially damage the compressor. If the flash tank drains out of liquid completely, two-phase refrigerant may then be provided being into a lower expansion value, which will impact its operation. To maintain the liquid level within the flash tank within the desired range of values, a pressure sensor may be provided to measure either a pressure differential or absolute pressure of the liquid refrigerant. This measurement may then be used to calculate the liquid level within the flash tank. A controller may then send control signals to an electronic expansion valve provided between a condenser and the flash tank to either open or close depending on the liquid level within the flash tank.

20 Claims, 5 Drawing Sheets

(56) References Cited

U.S. PATENT DOCUMENTS

| | | | | |
|---|---|---|---|---|
| 2010/0132399 | A1* | 6/2010 | Mitra | B60H 1/3228 62/512 |
| 2011/0162397 | A1* | 7/2011 | Huff | F25B 1/10 62/132 |
| 2012/0227427 | A1* | 9/2012 | Liu | F25B 41/39 62/190 |
| 2013/0171709 | A1* | 7/2013 | Kusuda | C12P 7/10 435/165 |
| 2015/0300713 | A1* | 10/2015 | Sun | F25B 49/02 62/157 |
| 2023/0392840 | A1* | 12/2023 | Hagh | F25B 41/20 |

* cited by examiner

SYSTEMS AND METHODS FOR FLASH TANK LIQUID LEVEL CONTROL

CROSS-REFERENCE TO RELATED APPLICATION

This application claims the benefit of U.S. Application No. 63/581,109, filed Sep. 7, 2023, the entirety of which is incorporated herein by reference.

TECHNICAL FIELD

The present disclosure relates generally to heating, ventilation, and air conditioning (HVAC) systems and more particularly to systems and methods for flash tank liquid level control.

BACKGROUND

In vapor compression refrigeration systems employing vapor injection compressors, a method may be used to separate the phases of the intermediate pressure vapor refrigerant before the gas is injected into the compressor. Economizers (e.g., brazed plate heat exchangers) can be used to boil the intermediate pressure refrigerant. However, using a flash tank to separate out the gas and liquid can often provide a lower-cost solution. Maintaining a desired liquid level in a flash tank, however, may be challenging. Generally, it is recommended to maintain the liquid level at between 40-60% of the height of the tank. If the flash tank overflows, liquid injected into the compressor can damage the compressor. If the flash tank drains out of liquid completely, then two-phase refrigerant may then be provided into a lower expansion valve, which may impact the performance of the expansion valve.

Figure 1:
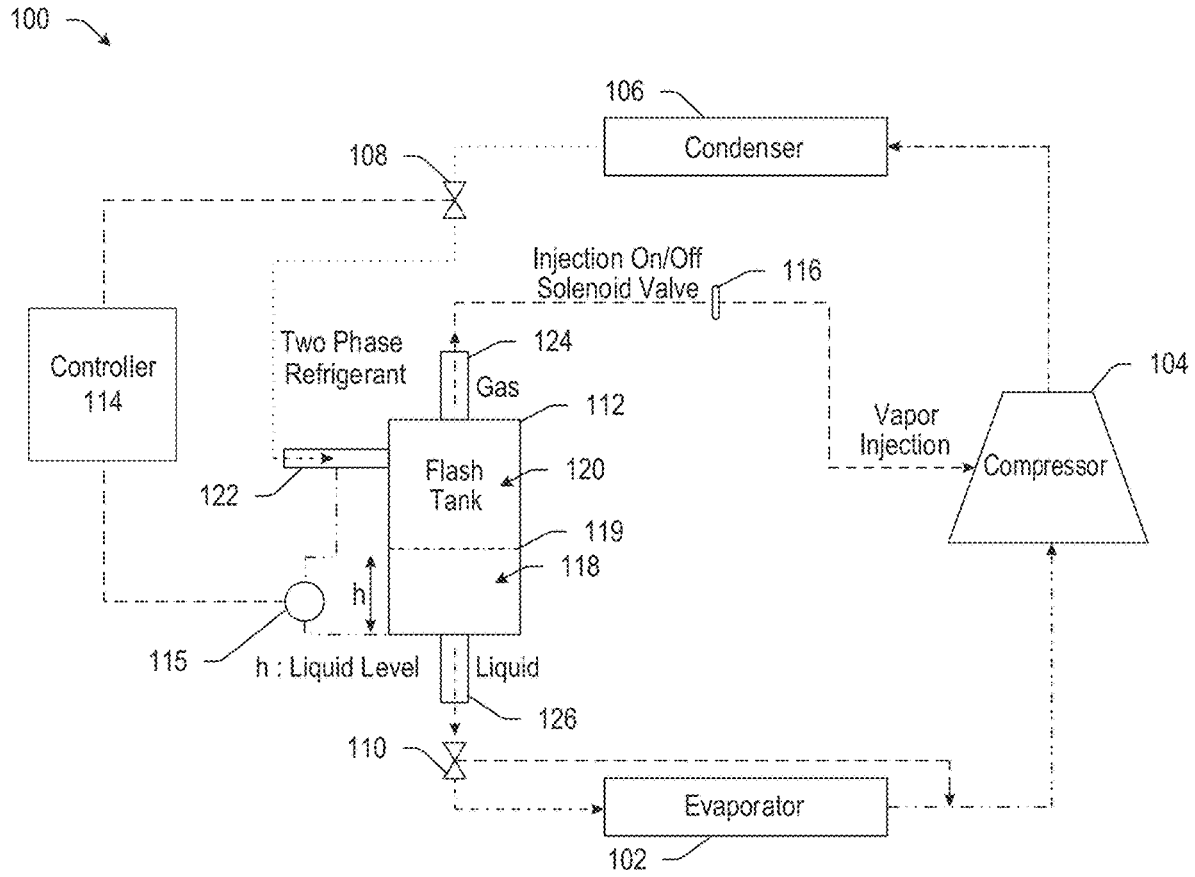
FIG. 1 illustrates an HVAC system, in accordance with one or more embodiments of the disclosure.

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. The use of the same reference numerals indicates similar but not necessarily the same or identical components; different reference numerals may be used to identify similar components as well. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

This disclosure relates to, among other things, systems and methods for flash tank liquid level control. A flash tank is a device used to separate the vapor (also referred to herein as "gas") and liquid phases of a refrigerant mixture. For example, a flash tank may be provided within a vapor compression refrigeration (VCR) loop of an HVAC system and may be used to separate two-phase refrigerant into its vapor and liquid refrigerant components. An HVAC system (which may also be referred to as an HVAC unit) may generally refer to an air conditioning unit, heat pump, and/or any other type of similar system. The flash tanks within such systems operate by acting as a tank where the two-phase refrigerant is provided space to separate out into gas and liquid phases due to the effects of gravity.

The separated vapor and liquid refrigerant stored within the flash tank may be supplied to different components of the system to improve the efficiency of the system. For example, the vapor may be selectively provided to a compressor within the system. Injecting additional vapor into the compressor keeps the compressor cool, allowing the compressor to operate at higher pressure ratios without overheating. Injecting the vapor also boosts flow rates in the condenser of the system. This, in turn, boosts the capacity of the system. The liquid refrigerant may be provided into an evaporator in the system. Removing the vapor from the two-phase mixture before providing the liquid refrigerant to the evaporator improves the efficiency of the evaporator because heat transfer rates may be improved due to the lower inlet quality of the refrigerant entering the evaporator.

Maintaining a desired liquid level (for example, the height of the volume of liquid refrigerant) within the flash tank is important for the efficient and reliable operation of the HVAC system. Generally, it may be desired to maintain a liquid level that is between 40-60% of the height of the flash tank (however, this is merely an exemplary range of values). If the flash tank overflows, liquid injected into the compressor may damage the compressor. Additionally, if the liquid refrigerant is drained completely from the flash tank, then the two-phase refrigerant may be provided into a lower electronic expansion valve and/or evaporator which may impact the operation of these components.

To ensure that the liquid level within the flash tank is maintained within a desired range, the systems and methods described herein involve dynamically controlling the amount of two-phase refrigerant that is provided to the flash tank. Within the system, a controller may be in electrical communication with an upper electronic expansion valve. The upper electronic expansion valve may be in fluid communication with the inlet of the flash tank and may control the amount of refrigerant that is provided to the flash tank from a condenser (this configuration is illustrated in further detail in FIG. 1). Thus, to control the amount of two-phase refrigerant that is provided to the flash tank, the controller may transmit electrical signals to the upper electronic expansion valve to open or close to regulate the flow of two-phase refrigerant from the condenser to the flash tank. For example, if it is determined that the liquid level within the flash tank surpasses a desired upper threshold liquid level, the controller may transmit a signal to close (or partially close) the upper electronic expansion valve to prevent two-phase refrigerant from being provided to the flash tank (or reduce the amount of two-phase refrigerant that is provided to the flash tank). Likewise, if it is determined that the liquid level within the flash tank is less than a desired lower threshold liquid level, the controller may transmit a signal to open (or partially open) the upper electronic expansion valve.

The liquid level within the flash tank may be determined based on sensor measurements. In one or more embodiments, a differential pressure sensor that measures the pressure of the liquid refrigerant within the flash tank may be provided within the system. Particularly, the pressure sensor may be configured to measure a pressure difference between the inlet of the flash tank and the base of the liquid refrigerant at the bottom of the flash tank. The differential pressure sensor may also determine the pressure based on measurements between any two other points. Alternatively, an absolute pressure sensor may be provided at the base of the liquid refrigerant. The sensor readings from the absolute pressure sensor may be used in combination with additional sensors (for example, one or more additional absolute pressure sensors provided at different locations and/or other types of sensors) to ensure the correct liquid level is maintained as the intermediate pressure may vary based on factors, such as different ambient conditions and/or compressor speeds, for example.

Once the pressure is obtained from the pressure sensor, the liquid level within the flash tank may be determined using the expression $p=\rho*g*h$, where 'p' is the pressure, 'ρ' is the density of the fluid, 'g' is the value acceleration due to gravity (for example, a constant value), and 'h' is the height of the liquid level that is being solved for. That is, the liquid level may be determined by dividing the pressure by $\rho*g$. ρ may be a known value or may be a value that is likely to be within a given range of values. If the value of ρ is unknown, an absolute pressure sensor may be used to measure an absolute pressure to determine the value of ρ for the liquid refrigerant.

Determining the liquid level of the refrigerant within the flash tank may not necessarily be limited to the use of pressure measurements. Any other types of sensors and/or combinations of sensors may also be used to determine the liquid level. As a first example, a float device may be provided within the flash tank. Float devices use the buoyancy of a float to indicate the liquid level in the flash tank. In some instances, the float device may be attached to a chain and the chain may be attached to a counterweight, which indicates the liquid level as the float moves up and down. As a second example, one or more cameras may be provided within or outside of the flash tank. The one or more cameras may capture images or video of the liquid refrigerant included within the flash tank and the liquid level may be determined based on the images or video. This determination may be made using a computer vision algorithm, for example. As a third example, sensors used to detect liquids or moisture may be provided at various heights within the flash tank. The liquid level of the liquid refrigerant may be determined based on identifying which of the sensors are currently detecting liquid or moisture. As a fourth example, mass flow meters may be provided at the inlet of the flash tank and an outlet of the flash tank through which liquid refrigerant is provided to a lower electronic expansion valve. The mass flow meters may be used to measure the mass entering and exiting the flash tank to determine the amount of liquid refrigerant within the flash tank. Any other suitable mechanism may also be used to determine the liquid level within the flash tank.

Turning to the figures, FIG. 1 shows an HVAC system 100, in accordance with one or more embodiments of the disclosure. The figure shows some of the primary components that may be included within a vapor-compression refrigeration (VCR) loop. The HVAC system 100 includes an evaporator 102, a compressor 104, a condenser 106, an upper electronic expansion valve 108, a lower electronic expansion valve 110, a flash tank 112, a controller 114, and a sensor 116.

Within the HVAC system 100, refrigerant is provided to the compressor 104 in a gaseous state and is compressed to a higher pressure (this also increases the temperature of the refrigerant). The warmer, compressed vapor may then be condensed using either cooling water or cooling air. The vapor then passes through the condenser 106. Within the condenser 106, heat from the refrigerant is transferred to an external medium (for example, an environment external to the HVAC system 100), allowing the vapor to cool and condense into a liquid refrigerant. The condensed liquid refrigerant is provided to an upper electronic expansion valve 108, which reduces the pressure of the liquid refrigerant. In the particular system 100 shown in FIG. 1, the upper electronic expansion valve 108 reduces the pressure to an intermediate pressure based on the type of compressor 104. This pressure reduction causes a portion of the liquid refrigerant to evaporate, which reduces the temperature of the liquid and vapor refrigerant mixture to where it is colder than the temperature of the environment to be cooled. Further expansion and pressure reduction is performed at the lower electronic expansion valve 110.

The cool liquid refrigerant and vapor mixture is then provided through the evaporator 102. Air in the system circulates across the coil or tubes of the evaporator 102 based on thermal convection or the use of a fan (not shown in the figure). Since the air is warmer than the cold liquid refrigerant, heat is transferred between the air and the refrigerant, which cools the air and causes evaporation of the liquid. This returns the liquid refrigerant to the gaseous state while also absorbing heat. While liquid refrigerant does remain, the temperature of the liquid refrigerant temperature may not rise above the boiling point of the refrigerant, which depends on the pressure in the evaporator. To complete the VCR loop, the vapor from the evaporator 102 is again routed back into the compressor 104.

In some HVAC systems, a flash tank 112 may also be provided between the condenser 106 and the evaporator 102. A flash tank 112 is a device used to separate the vapor and liquid phases of a two-phase refrigerant. These flash tanks 112 operate by acting as a tank where the two phase refrigerant is provided space to separate out into gas and liquid phases due to the effects of gravity 112. The vapor and liquid refrigerant may then be separately supplied to different components of the system 100 to improve the efficiency of the system 100. For example, the vapor may be selectively provided to the compressor 104. Injecting additional vapor into the compressor 104 keeps the compressor 104 allowing it to operate at higher pressure ratios without overheating, and boosts flow rates in a condenser 104. This, in turn, boosts the capacity of the system 100. The liquid refrigerant may be provided into the evaporator 102. Removing the vapor from the two-phase mixture before providing the refrigerant to the evaporator 102 improves the efficiency of the evaporator because heat transfer rates may be improved due to the lower inlet quality of the refrigerant entering the evaporator.

As shown in FIG. 1, the flash tank includes separated liquid refrigerant 118 (represented by a liquid line 119) and vapor 120. The flash tank 112 also includes an inlet 122, a first outlet 124, and a second outlet 126. Two-phase refrigerant is provided to the flash tank 112 through the inlet 122 from the upper expansion valve 108. The two-phase refrigerant is then separated within the flash tank 112 into the vapor 120 and the liquid refrigerant 118. The vapor is selectively provided to the compressor 104 through the first outlet 124 based on control of the valve 116. Liquid refrigerant 118 is provided to the evaporator 102 through control of the lower electronic expansion valve 110.

In one or more embodiments, the amount of vapor that is provided to the compressor 104 by the flash tank 112 may be regulated using a valve 116. For example, the valve may be in electrical communication with the controller 112. The controller 112 may provide electrical signals to open and/or close (or partially open and/or partially close) the valve to control the amount of vapor provided to the compressor 104. However, the valve 116 may also be opened and/or closed based on any other trigger mechanism. Additionally, any other mechanism may be used to regulate the flow of vapor from the flash tank 112 to the compressor 104.

The controller 114 may be a component with processing capabilities that is configured to transmit and/or receive electronic signals to and/or from any other components of the system 100. For example, the controller 114 may be a proportional-integral-derivative (PID) controller. The controller may include any of the elements described with respect to the computing device 500 of FIG. 5 (e.g., processors, memory, etc.). The controller 114 may also include logic used to determine the control signals that should be sent to control the operation of the components of the system 100. For example, the controller 114 may be in electrical communication with the upper electronic expansion valve 108 and the lower electronic expansion valve 110. In this manner, the controller 114 may send electronic signals to the upper electronic expansion valve 108 and the lower electronic expansion valve 110 to cause the upper electronic expansion valve 108 and the lower electronic expansion valve 110 to open, partially open, close, or partially close. Likewise, the controller 114 may be in electrical communication with the valve 116 to selectively control the injection of vapor 120 from the flash tank 112 to the compressor 104. The controller 114 may also be in electrical communication with any other component of the system 100 or any system or device not shown in the figure.

The controller 114 may either be provided locally to the system 100 or may be located remotely from the system 100. For example, the controller 114 may be integrated into the system 100 or may be provided within the environment in which the system 100 is installed. As another example, the control logic may be hosted on a remote server. Additionally, multiple controllers 114 may be provided that may be located remotely and/or locally to the system 100.

To ensure that the liquid level within the flash tank 112 is maintained within the desired range, the systems and methods described herein involve dynamically controlling the amount of two-phase refrigerant that is provided to the flash tank 112 (for example, through the inlet 122). As aforementioned, the controller 112 may be in electrical communication with the upper electronic expansion valve 108. The upper electronic expansion valve 108 may be in fluid communication with the inlet 122 of the flash tank 112. Thus, to control the amount of two-phase refrigerant that is provided to the flash tank 112, the controller 114 may transmit electrical signals to the upper electronic expansion valve 108 to open or close (or partially open or close) to regulate the flow of two-phase refrigerant from the condenser 106, through the upper electronic expansion valve 108 to the flash tank 112. For example, if it is determined that the liquid level 119 within the flash tank 112 surpasses a desired upper threshold liquid level, the controller 114 may transmit a signal to close (or partially close) the upper electronic expansion valve 108 to prevent two-phase refrigerant from being provided to the flash tank 112 (or reduce the amount of two-phase refrigerant that is provided to the flash tank 112). Likewise, if it is determined that the liquid level 119 within the flash tank 112 is less than a desired lower threshold liquid level, the controller 114 may transmit a signal to open (or partially open) the upper electronic expansion valve 108.

The liquid level 119 within the flash tank 112 may be determined based on sensor measurements. In one or more embodiments, a differential pressure sensor 115 that measures the pressure of the liquid refrigerant 118 within the flash tank 112 may be provided within the system 100. Particularly, the pressure sensor 115 may be configured to measure a pressure difference between the inlet 122 of the flash tank 112 and a base of the liquid refrigerant 118 at the bottom of the flash tank 112. However, an absolute pressure sensor may alternatively be provided at the base of the liquid refrigerant 118. The sensor readings from the absolute pressure sensor may be used in combination with additional sensors (for example, one or more additional absolute pressure sensors provided at different locations and/or other types of sensors) to ensure the desired liquid level is maintained as the intermediate pressure may vary based on factors, such as different ambient conditions and/or compressor speeds, for example.

Once the pressure is obtained from the pressure sensor 115, the liquid level 119 within the flash tank may be determined using the expression $p=\rho*g*h$, where 'p' is the pressure, 'ρ' is the density of the fluid, 'g' is acceleration due to gravity, and 'h' is the height of the liquid level that is being solved for. That is, the liquid level may be determined by dividing the pressure by $\rho*g$. If the value of ρ is unknown, an absolute pressure sensor may be used to measure an absolute pressure to determine the value of ρ for the liquid refrigerant.

Figure 2:
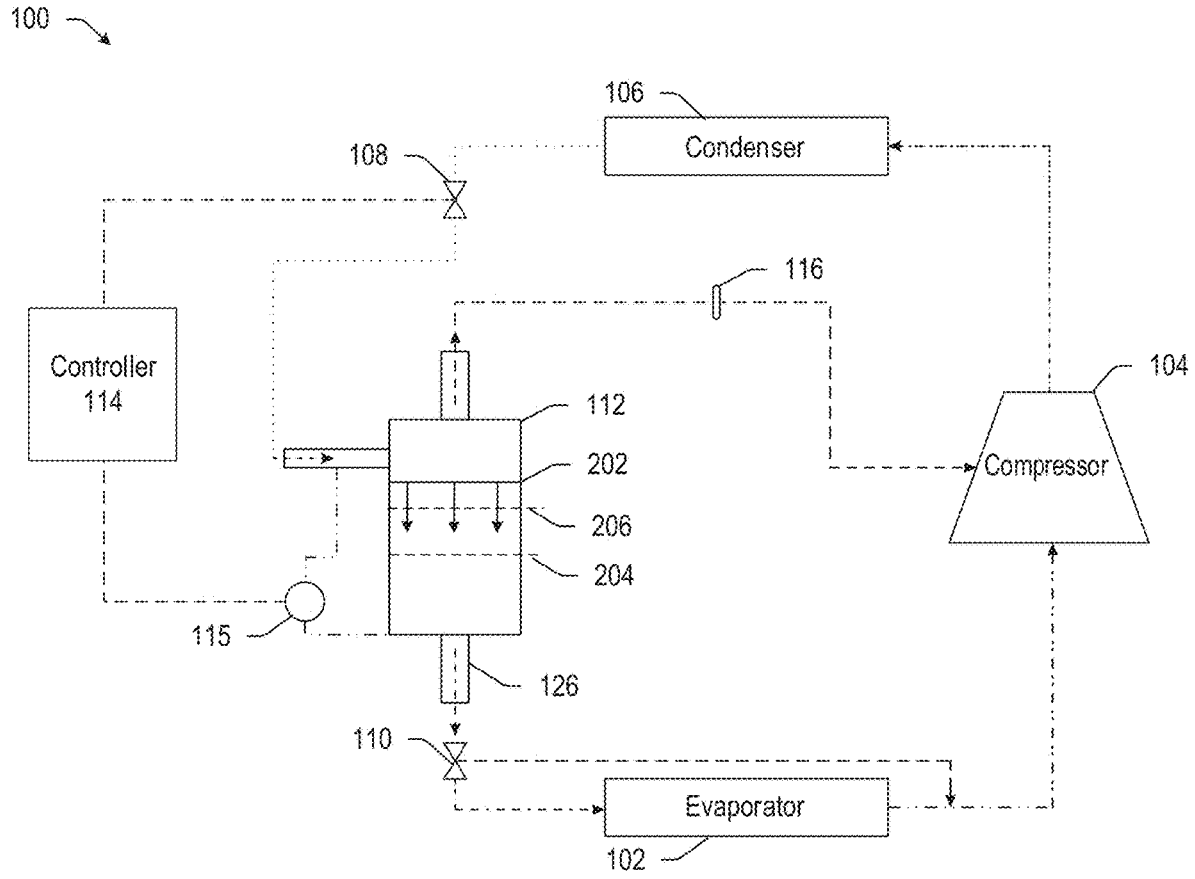
FIG. 2 illustrates control of an expansion valve to add refrigerant to a flash tank, in accordance with one or more embodiments of the disclosure.

FIG. 2 illustrates control of the upper electronic expansion valve 108 to add refrigerant to the flash tank 112. Particularly, the figure shows the flash tank 112 with a liquid level 202 equivalent to 70% of the height of the flash tank 112. In this example, the desired lower liquid level threshold 204 and upper liquid level threshold 206 may be 40% and 60% of the flash tank 112, respectively. Thus, the liquid level 202 at 70% of the height of the flash tank 112 is above the desired upper liquid level threshold 206. This may potentially result in liquid refrigerant being injected into the compressor, which may potentially impede the operation of the compressor 104. The controller 114 may determine that the liquid level is at 70% by obtaining a differential pressure measurement from the sensor 116 (which may be a differential pressure sensor in this example).

Once the controller 114 determines that the current liquid level 202 is above the desired upper liquid level threshold 206, the controller 114 transmits an electrical signal to the upper electronic expansion valve 108 to close (or partially close) the upper electronic expansion valve 108 to prevent additional two-phase refrigerant from being supplied to the flash tank 112 (or reduce the rate at which two-phase refrigerant is supplied to the flash tank 112). FIG. 2 shows that closing the upper electronic expansion valve 108 causes the liquid level 202 to decrease as two-phase refrigerant is no longer being introduced into the flash tank 112 (or is being introduced at a slower rate than the liquid refrigerant is exiting the flash tank 112) to replace the liquid refrigerant that is being provided to the lower electronic expansion valve 110 through the second outlet 126 of the flash tank 112.

The controller 114 may continue to monitor data from the sensor 116 to determine changes to the liquid level 202 of the flash tank 112 over time after the upper electronic expansion valve 108 is closed or partially closed. Once the liquid level 202 is below the upper threshold value, the controller 114 may, in some instances, transmit another signal to open or partially open the upper electronic expansion valve 108. However, in some instances, the controller 114 may not send such a signal until the liquid level is determined to be below the lower threshold value (this scenario is described with respect to FIG. 3).

Figure 3:
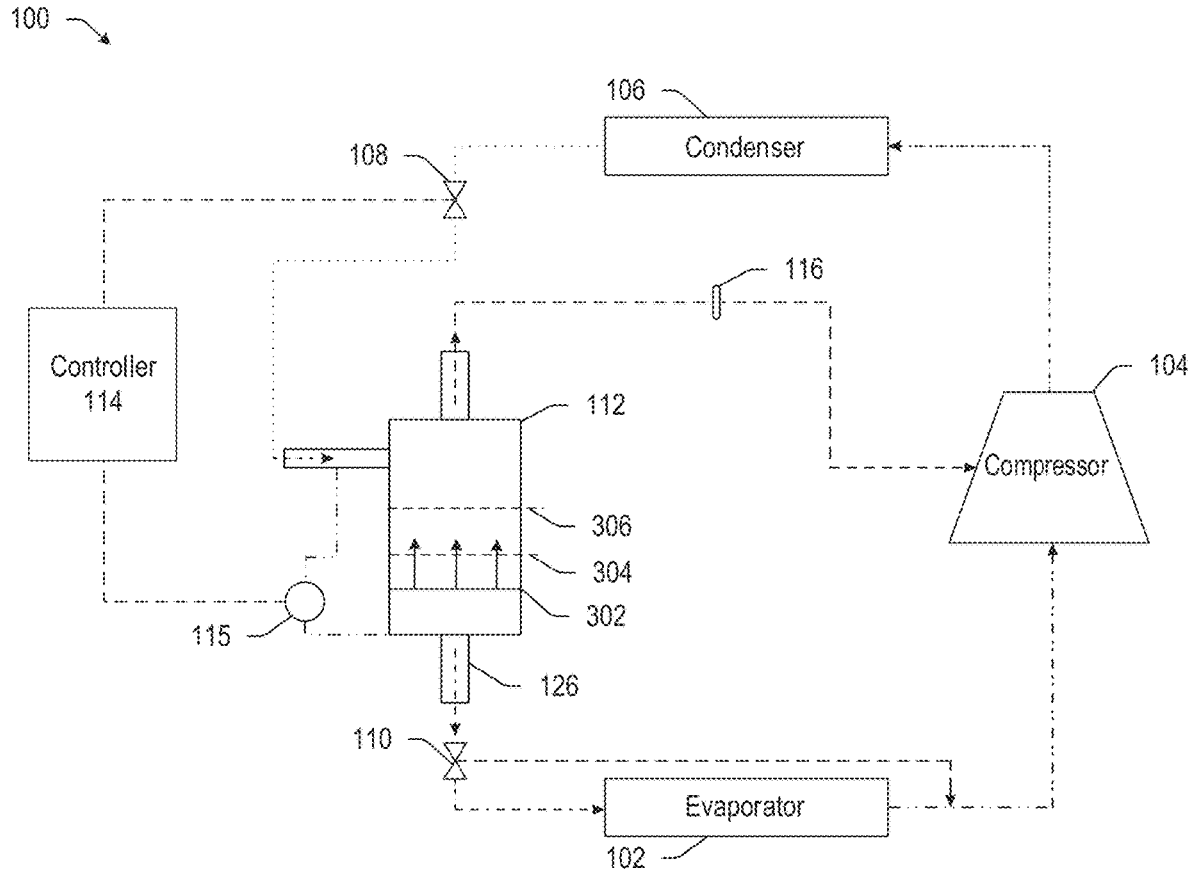
FIG. 3 illustrates control of an expansion valve to reduce refrigerant in a flash tank, in accordance with one or more embodiments of the disclosure.

FIG. 3 illustrates control of the upper electronic expansion valve 108 to reduce refrigerant in the flash tank 112. Particularly, the figure shows the flash tank 112 with a liquid level 302 equivalent to 30% of the height of the flash tank 112. In this example, the desired lower liquid level threshold 304 and upper liquid level threshold 306 may also be 40% and 60% of the flash tank 112, respectively. Thus, the liquid level 302 at 30% of the height of the flash tank 112 is below the desired lower liquid level threshold 304. If the flash tank 112 drains out of liquid completely, then two-phase refrigerant may then be provided into the lower expansion valve 110, which may impact the performance of the lower electronic expansion valve 110 and the evaporator 102.

Once the controller 114 determines that the liquid level 302 is below the desired lower liquid level threshold 304, the controller 114 may transmit an electrical signal to the upper electronic expansion valve 108 to open (or partially open) the upper electronic expansion valve 108 to allow additional two-phase refrigerant to flow into the flash tank 112 (or increase the rate at which two-phase refrigerant is supplied to the flash tank 112).

The controller 114 may continue to monitor data from the sensor 116 to determine changes to the liquid level of the flash tank over time after the upper electronic expansion valve 108 is opened or partially opened. Once the liquid level is above the lower liquid level threshold 304, the controller 114 may, in some instances, transmit another signal to close or partially close the upper electronic expansion valve 108. However, in some instances, the controller 114 may not send such a signal until the liquid level is determined to be above the upper threshold value 306 (as described with respect to FIG. 2).

Figure 4:
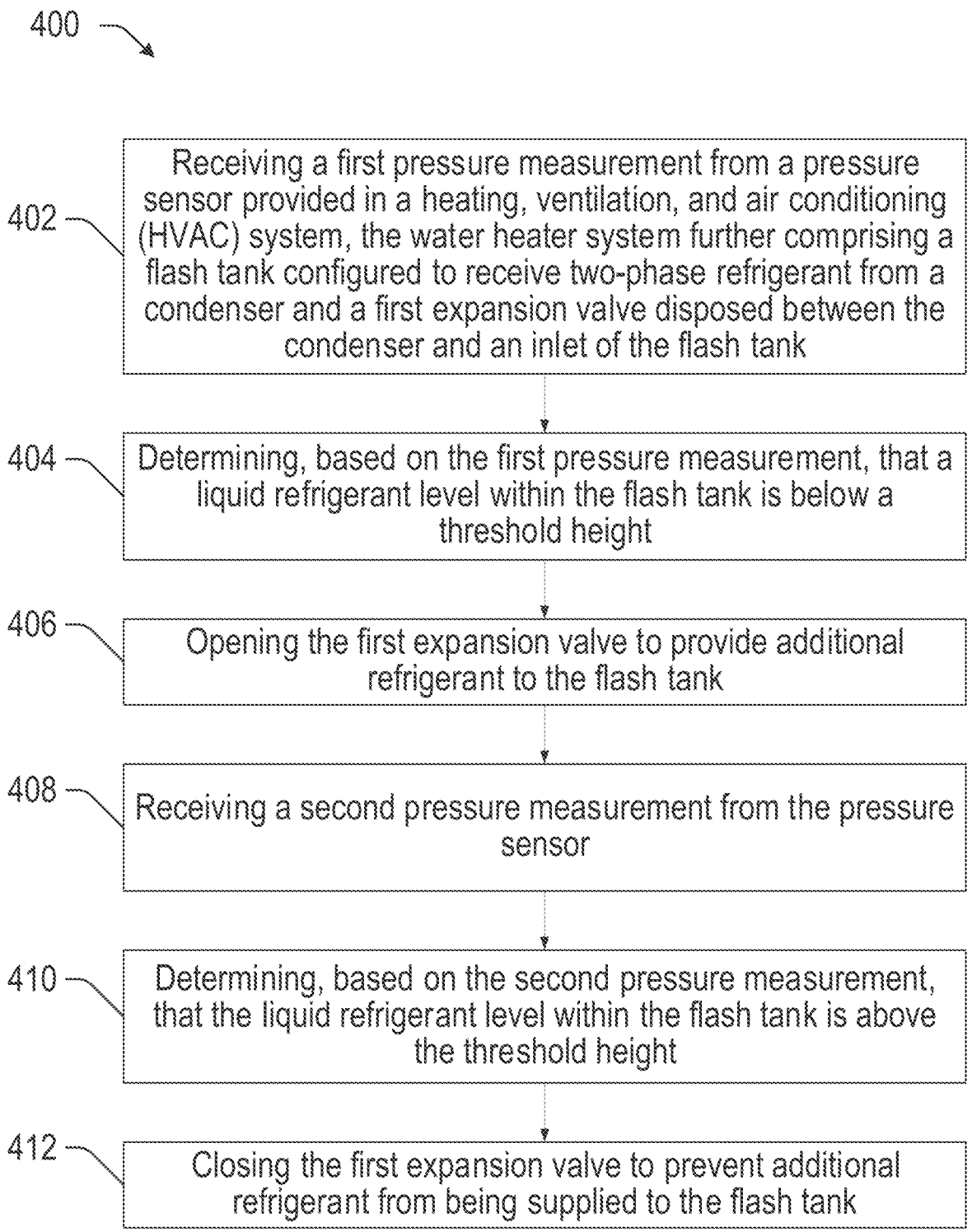
FIG. 4 is a method for performing flash tank liquid level control, in accordance with one or more embodiments of the disclosure.

FIG. 4 is an example method 400, in accordance with one or more embodiments of the disclosure. The method 400 may be performed by any of the systems or devices described herein (for example, controller 114, the computing system 600, and/or any other device and/or system described herein or otherwise).

At block 402, the method 400 may include receiving a first pressure measurement from a pressure sensor provided in a heating, ventilation, and air conditioning (HVAC) system, the HVAC system further comprising a flash tank configured to receive two-phase refrigerant from a condenser and a first expansion valve disposed between the condenser and an inlet of the flash tank. For example, the flash tank may be the flash tank 112 of FIGS. 1-3. The pressure sensor may be a differential pressure sensor that may be used to measure a pressure difference between an inlet of the flash tank through which two-phase refrigerant is received and a base of liquid refrigerant stored within the flash tank. Alternatively, the pressure sensor may include one or more absolute pressure sensors provided within the flash tank or otherwise.

Determining the liquid level of the refrigerant within the flash tank may not necessarily be limited to the use of pressure measurements. Any other types of sensors and/or combinations of sensors may also be used to determine the liquid level. As a first example, a float device may be provided within the flash tank. Float devices use the buoyancy of a float to indicate the liquid level in the flash tank. In some instances, the float device may be attached to a chain and the chain may be attached to a counterweight, which indicates the liquid level as the float moves up and down. As a second example, one or more cameras may be provided within or outside of the flash tank. The one or more cameras may capture images or video of the liquid refrigerant included within the flash tank and the liquid level may be determined based on the images or video. This determination may be made using a computer vision algorithm, for example. As a third example, sensors used to detect liquids or moisture may be provided at various heights within the flash tank. The liquid level of the liquid refrigerant may be determined based on identifying which of the sensors are currently detecting liquid or moisture. As a fourth example, mass flow meters may be provided at the inlet of the flash tank and an outlet of the flash tank through which liquid refrigerant is provided to a lower electronic expansion valve. The mass flow meters may be used to measure the mass entering and exiting the flash tank to determine the amount of liquid refrigerant within the flash tank. Any other suitable mechanism may also be used to determine the liquid level within the flash tank.

At block 404, the method 400 may include determining, based on the first pressure measurement, that a liquid refrigerant level within the flash tank is below a threshold height. In some instances, there may be a pre-determined range of heights in which it is desired for the liquid level of the liquid refrigerant within the flash tank to remain. For example, it may be desired to maintain the liquid level between 40-60% of the height of the flash tank. Thus, the determination in block 404 may involve determining that the liquid level is below 40% of the height of the flash tank (this is merely exemplary).

At block 406, the method 400 may include opening the first expansion valve to provide additional refrigerant to the flash tank. For example, as described in FIG. 3, the upper electronic expansion valve 108 may be opened or partially opened to allow for two-phase refrigerant to be supplied from the condenser 106 to the inlet 122 of the flash tank 112. This, in turn, causes the liquid level within the flash tank to rise as additional refrigerant is introduced to the flash tank.

At block 408, the method 400 may include receiving a second pressure measurement from the pressure sensor. At block 410, the method 400 may include determining, based on the second pressure measurement, that the liquid refrigerant level within the flash tank is above the threshold height.

At block 412, the method 400 may include closing the first expansion valve to prevent additional refrigerant from being supplied to the flash tank. For example, as described in FIG. 2, the upper electronic expansion valve 108 may be closed or partially closed to prevent two-phase refrigerant from being supplied from the condenser 106 to the inlet 122 of the flash tank 112 (or to reduce the rate at which two-phase refrigerant is supplied). This, in turn, causes the liquid level within the flash tank to fall as less refrigerant is introduced to the flash tank.

Figure 5:
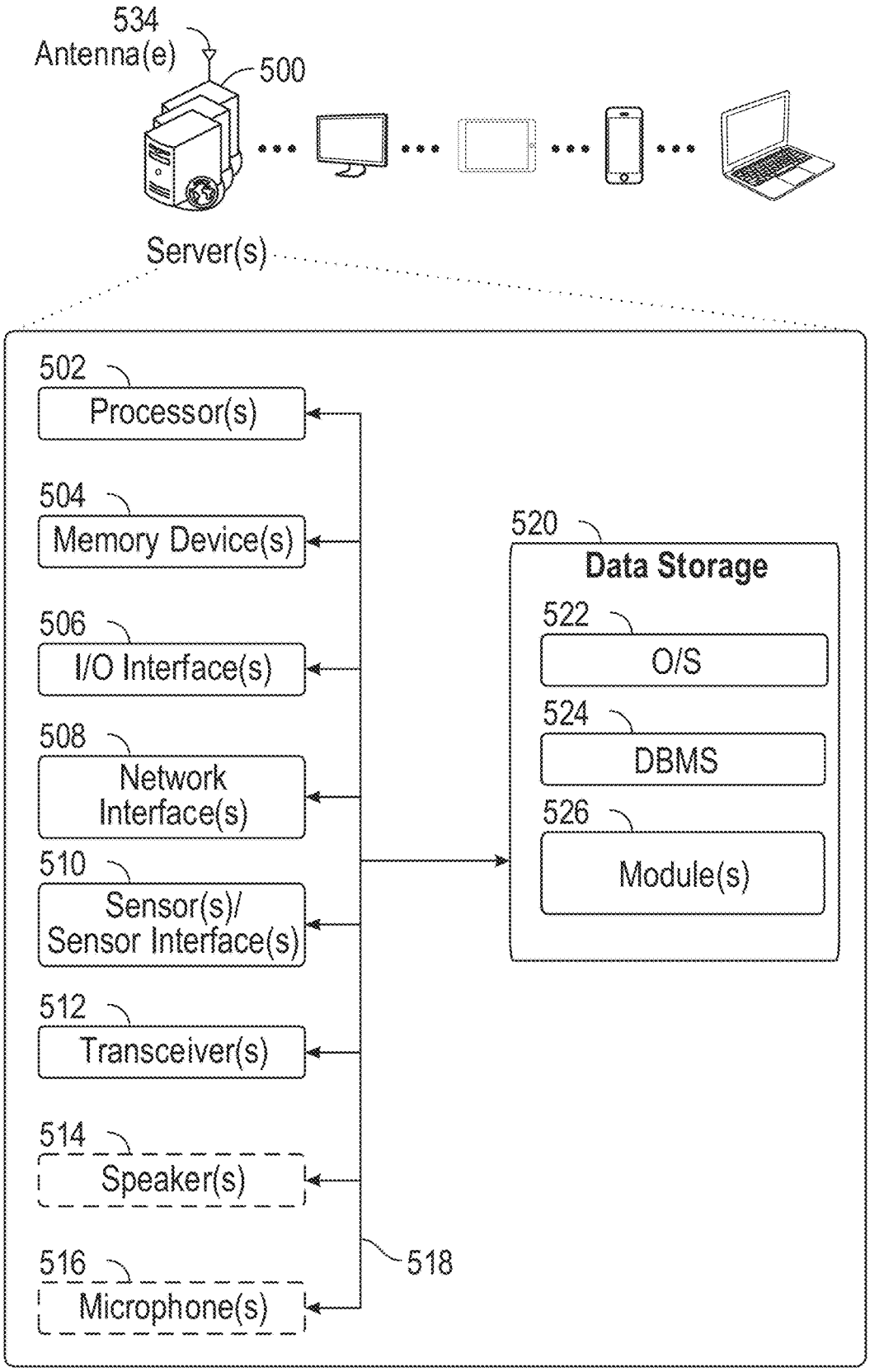
FIG. 5 is an example computing device, in accordance with one or more embodiments of the disclosure.

FIG. 5 is a schematic block diagram of one or more illustrative computing device(s) 500 in accordance with one or more example embodiments of the disclosure. The computing device(s) 500 may include any suitable computing device including, but not limited to, a server system, a mobile device such as a smartphone, a tablet, an e-reader, a wearable device, or the like; a desktop computer; a laptop computer; a content streaming device; a set-top box; or the like. The computing device(s) 500 may correspond to an illustrative device configuration for any of the computing systems described herein and/or any other system and/or device.

The computing device(s) 500 may be configured to communicate via one or more networks. Such network(s) may include, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks. Further, such network(s) may have any suitable communication range associated therewith and may include, for example, global networks (e.g., the Internet), metropolitan area networks (MANs), wide area networks (WANs), local area networks (LANs), or personal area networks (PANs). In addition, such network(s) may include communication links and associated networking devices (e.g., link-layer switches, routers, etc.) for transmitting network traffic over any suitable type of medium including, but not limited to, coaxial cable, twisted-pair wire (e.g., twisted-pair copper wire), optical fiber, a hybrid fiber-coaxial (HFC) medium, a microwave medium, a radio frequency communication medium, a satellite communication medium, or any combination thereof.

In an illustrative configuration, the computing device(s) 500 may include one or more processors (processor(s)) 502, one or more memory devices 504 (generically referred to herein as memory 504), one or more input/output (I/O) interfaces 506, one or more network interfaces 508, one or more sensors or sensor interfaces 510, one or more transceivers 512, one or more optional speakers 514, one or more optional microphones 516, and data storage 520. The computing device(s) 500 may further include one or more buses 518 that functionally couple various components of the computing device(s) 500. The computing device(s) 500 may further include one or more antenna (e) 534 that may include, without limitation, a cellular antenna for transmitting or receiving signals to/from a cellular network infrastructure, an antenna for transmitting or receiving Wi-Fi signals to/from an access point (AP), a Global Navigation Satellite System (GNSS) antenna for receiving GNSS signals from a GNSS satellite, a Bluetooth antenna for transmitting or receiving Bluetooth signals, a Near Field Communication (NFC) antenna for transmitting or receiving NFC signals, and so forth. These various components will be described in more detail hereinafter.

The bus(es) 518 may include at least one of a system bus, a memory bus, an address bus, or a message bus, and may permit the exchange of information (e.g., data (including computer-executable code), signaling, etc.) between various components of the computing device(s) 500. The bus(es) 518 may include, without limitation, a memory bus or a memory controller, a peripheral bus, an accelerated graphics port, and so forth. The bus(es) 518 may be associated with any suitable bus architecture including, without limitation, an Industry Standard Architecture (ISA), a Micro Channel Architecture (MCA), an Enhanced ISA (EISA), a Video Electronics Standards Association (VESA) architecture, an Accelerated Graphics Port (AGP) architecture, a Peripheral Component Interconnect (PCI) architecture, a PCI-Express architecture, a Personal Computer Memory Card International Association (PCMCIA) architecture, a Universal Serial Bus (USB) architecture, and so forth.

The memory 504 of the computing device(s) 500 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. Persistent data storage, as that term is used herein, may include non-volatile memory. In certain example embodiments, volatile memory may enable faster read/write access than non-volatile memory. However, in certain other example embodiments, certain types of non-volatile memory (e.g., FRAM) may enable faster read/write access than certain types of volatile memory.

In various implementations, the memory 504 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth. The memory 504 may include main memory as well as various forms of cache memory such as instruction cache(s), data cache(s), translation lookaside buffer(s) (TLBs), and so forth. Further, cache memory such as a data cache may be a multi-level cache organized as a hierarchy of one or more cache levels (L1, L2, etc.).

The data storage 520 may include removable storage and/or non-removable storage, including, but not limited to, magnetic storage, optical disk storage, and/or tape storage. The data storage 520 may provide non-volatile storage of computer-executable instructions and other data. The memory 504 and the data storage 520, removable and/or non-removable, are examples of computer-readable storage media (CRSM) as that term is used herein.

The data storage 520 may store computer-executable code, instructions, or the like that may be loadable into the memory 504 and executable by the processor(s) 502 to cause the processor(s) 502 to perform or initiate various operations. The data storage 520 may additionally store data that may be copied to the memory 504 for use by the processor(s) 502 during the execution of the computer-executable instructions. Moreover, output data generated as a result of execution of the computer-executable instructions by the processor(s) 502 may be stored initially in the memory 504, and may ultimately be copied to the data storage 520 for non-volatile storage.

More specifically, the data storage 520 may store one or more operating systems (O/S) 522; one or more database management systems (DBMSs) 524; and one or more program module(s), applications, engines, computer-executable code, scripts, or the like such as, for example, one or more flash tank control module(s) 526. Some or all of these module(s) may be sub-module(s). Any of the components depicted as being stored in the data storage 520 may include any combination of software, firmware, and/or hardware. The software and/or firmware may include computer-executable code, instructions, or the like that may be loaded into the memory 504 for execution by one or more of the processor(s) 502. Any of the components depicted as being stored in the data storage 520 may support functionality described in reference to corresponding components named earlier in this disclosure.

The data storage 520 may further store various types of data utilized by the components of the computing device(s) 500. Any data stored in the data storage 520 may be loaded into the memory 504 for use by the processor(s) 502 in executing computer-executable code. In addition, any data depicted as being stored in the data storage 520 may potentially be stored in one or more datastore(s) and may be accessed via the DBMS 524 and loaded in the memory 504 for use by the processor(s) 502 in executing computer-executable code. The datastore(s) may include, but are not limited to, databases (e.g., relational, object-oriented, etc.), file systems, flat files, distributed datastores in which data is stored on more than one node of a computer network, peer-to-peer network datastores, or the like.

The processor(s) 502 may be configured to access the memory 504 and execute the computer-executable instructions loaded therein. For example, the processor(s) 502 may be configured to execute the computer-executable instructions of the various program module(s), applications, engines, or the like of the computing device(s) 500 to cause or facilitate various operations to be performed in accordance with one or more embodiments of the disclosure. The processor(s) 502 may include any suitable processing unit capable of accepting data as input, processing the input data in accordance with stored computer-executable instructions, and generating output data. The processor(s) 502 may include any type of suitable processing unit including, but not limited to, a central processing unit, a microprocessor, a reduced instruction set computer (RISC) microprocessor, a complex instruction set computer (CISC) microprocessor, a microcontroller, an application-specific integrated circuit (ASIC), a field-programmable gate array (FPGA), a system-on-a-chip (SoC), a digital signal processor (DSP), and so forth. Further, the processor(s) 502 may have any suitable microarchitecture design that includes any number of constituent components such as, for example, registers, multiplexers, arithmetic logic units, cache controllers for controlling read/write operations to cache memory, branch predictors, or the like. The microarchitecture design of the processor(s) 502 may be capable of supporting any of a variety of instruction sets.

Referring now to functionality supported by the various program module(s) depicted in FIG. 5, the flash tank control module(s) 526 may include computer-executable instructions, code, or the like that responsive to execution by one or more of the processor(s) 502 may perform functions including, but not limited to, receiving sensor measurements, determining a liquid level within a flash tank, providing control signals to an upper electronic expansion valve to open or close to control the amount of two-phase refrigerant provided to the flash tank, etc.

Referring now to other illustrative components depicted as being stored in the data storage 520, the O/S 522 may be loaded from the data storage 520 into the memory 504 and may provide an interface between other application software executing on the computing device(s) 500 and the hardware resources of the computing device(s) 500. More specifically, the O/S 522 may include a set of computer-executable instructions for managing hardware resources of the computing device(s) 500 and for providing common services to other application programs (e.g., managing memory allocation among various application programs). The O/S 522 may include any operating system now known or which may be developed in the future, including, but not limited to, any server operating system, any mainframe operating system, or any other proprietary or non-proprietary operating system.

The DBMS 524 may be loaded into the memory 504 and may support functionality for accessing, retrieving, storing, and/or manipulating data stored in the memory 504 and/or data stored in the data storage 520. The DBMS 524 may use any of a variety of database models (e.g., relational model, object model, etc.) and may support any of a variety of query languages. The DBMS 524 may access data represented in one or more data schemas and stored in any suitable data repository including, but not limited to, databases (e.g., relational, object-oriented, etc.), file systems, flat files, distributed datastores in which data is stored on more than one node of a computer network, peer-to-peer network datastores, or the like. In those example embodiments in which the computing device(s) 500 is a mobile device, the DBMS 524 may be any suitable lightweight DBMS optimized for performance on a mobile device.

Referring now to other illustrative components of the computing device(s) 500, the I/O interface(s) 506 may facilitate the receipt of input information by the computing device(s) 500 from one or more I/O devices as well as the output of information from the computing device(s) 500 to one or more I/O devices. The I/O devices may include any of a variety of components such as a display or display screen having a touch surface or touchscreen; an audio output device for producing sound, such as a speaker; an audio capture device, such as a microphone; an image and/or video capture device, such as a camera; a haptic unit; and so forth. Any of these components may be integrated into the computing device(s) 500 or may be separate. The I/O devices may further include, for example, any number of peripheral devices such as data storage devices, printing devices, and so forth.

The I/O interface(s) 506 may also include an interface for an external peripheral device connection such as a USB, FireWire, Thunderbolt, Ethernet port or other connection protocol that may connect to one or more networks. The I/O interface(s) 506 may also include a connection to one or more of the antenna (e) 534 to connect to one or more networks via a wireless local area network (WLAN) (such as Wi-Fi) radio, Bluetooth, ZigBee, and/or a wireless network radio, such as a radio capable of communication with a wireless communication network such as a Long Term Evolution (LTE) network, WiMAX network, 3G network, etc.

The computing device(s) 500 may further include one or more network interface(s) 508 via which the computing device(s) 500 may communicate with any of a variety of other systems, platforms, networks, devices, and so forth. The network interface(s) 508 may enable communication, for example, with one or more wireless routers, one or more host servers, one or more web servers, and the like via one or more networks.

The antenna (e) 534 may include any suitable type of antenna depending, for example, on the communications protocols used to transmit or receive signals via the antenna (e) 534. Non-limiting examples of suitable antennae may include directional antennae, non-directional antennae, dipole antennae, folded dipole antennae, patch antennae, multiple-input multiple-output (MIMO) antennae, or the like. The antenna (c) 534 may be communicatively coupled to one or more transceivers 512 or radio components to which or from which signals may be transmitted or received.

The sensor(s)/sensor interface(s) 510 may include or may be capable of interfacing with any suitable type of sensing device such as, for example, pressure sensors, cameras, etc.

It should be appreciated that the program module(s), applications, computer-executable instructions, code, or the like depicted in FIG. 5 as being stored in the data storage 520 are merely illustrative and not exhaustive and that processing described as being supported by any particular module may alternatively be distributed across multiple module(s) or performed by a different module. In addition, various program module(s), script(s), plug-in(s), application programming interface(s) (API(s)), or any other suitable computer-executable code hosted locally on the computing device(s) 500, and/or hosted on other computing device(s) accessible via one or more networks, may be provided to support functionality provided by the program module(s), applications, or computer-executable code depicted in FIG. 5 and/or additional or alternate functionality. Further, functionality may be modularized differently such that processing described as being supported collectively by the collection of program module(s) depicted in FIG. 5 may be performed by a fewer or greater number of module(s), or functionality described as being supported by any particular module may be supported, at least in part, by another module. In addition, program module(s) that support the functionality described herein may form part of one or more applications executable across any number of systems or devices in accordance with any suitable computing model such as, for example, a client-server model, a peer-to-peer model, and so forth. In addition, any of the functionality described as being supported by any of the program module (s) depicted in FIG. 5 may be implemented, at least partially, in hardware and/or firmware across any number of devices.

It should further be appreciated that the computing device (s) 500 may include alternate and/or additional hardware, software, or firmware components beyond those described or depicted without departing from the scope of the disclosure. More particularly, it should be appreciated that software, firmware, or hardware components depicted as forming part of the computing device(s) 500 are merely illustrative and that some components may not be present or additional components may be provided in various embodiments. While various illustrative program module(s) have been depicted and described as software module(s) stored in the data storage 520, it should be appreciated that functionality described as being supported by the program module(s) may be enabled by any combination of hardware, software, and/or firmware. It should further be appreciated that each of the above-mentioned module(s) may, in various embodiments, represent a logical partitioning of supported functionality. This logical partitioning is depicted for ease of explanation of the functionality and may not be representative of the structure of software, hardware, and/or firmware for implementing the functionality. Accordingly, it should be appreciated that functionality described as being provided by a particular module may, in various embodiments, be provided at least in part by one or more other module(s). Further, one or more depicted module(s) may not be present in certain embodiments, while in other embodiments, additional module(s) not depicted may be present and may support at least a portion of the described functionality and/or additional functionality. Moreover, while certain module(s) may be depicted and described as sub-module(s) of another module, in certain embodiments, such module(s) may be provided as independent module(s) or as sub-module (s) of other module(s).

One or more operations of the methods, process flows, and use cases of FIGS. 1-4 may be performed by a device having the illustrative configuration depicted in FIG. 5, or more specifically, by one or more engines, program module (s), applications, or the like executable on such a device. It should be appreciated, however, that such operations may be implemented in connection with numerous other device configurations.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Program module(s), applications, or the like disclosed herein may include one or more software components, including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines, and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a CRSM that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program module(s), or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

That which is claimed is:

1. A system comprising:

a flash tank configured to receive two-phase refrigerant from a condenser;

a first expansion valve disposed between the condenser and an inlet of the flash tank;

a pressure sensor configured to measure a pressure of liquid refrigerant in the flash tank; and a controller configured to:

receive a first pressure measurement from the pressure sensor;

determine, based on the first pressure measurement, that a liquid refrigerant level within the flash tank is below a threshold height; and open the first expansion valve to provide additional refrigerant to the flash tank.

2. The system of claim 1, wherein the controller is further configured to:

receive a second pressure measurement from the pressure sensor;

determine, based on the second pressure measurement, that the liquid refrigerant level within the flash tank is above the threshold height; and close the first expansion valve to prevent additional refrigerant from being supplied to the flash tank.

3. The system of claim 1, wherein the pressure sensor is a differential pressure sensor configured to measure a pressure difference between the inlet of the flash tank and a base of the flash tank.

4. The system of claim 1, wherein the pressure sensor is a first absolute pressure sensor disposed at a base of a liquid refrigerant within the flash tank.

5. The system of claim 4, further comprising an additional absolute pressure sensor disposed at a different location within the flash tank than the first absolute pressure sensor.

6. The system of claim 1, wherein the flash tank is further configured to separate the two-phase refrigerant into a liquid refrigerant and a gaseous refrigerant, wherein the liquid refrigerant is provided to an evaporator and the gaseous refrigerant is provided to a compressor.

7. The system of claim 1, further comprising a second expansion valve disposed between the flash tank and an evaporator, wherein the first expansion valve is configured to reduce a first pressure of refrigerant received from the condenser to a second pressure, and wherein the second expansion valve is configured to reduce a third pressure of refrigerant received from the flash tank to a fourth pressure.

8. A method comprising:

receiving a first pressure measurement from a pressure sensor provided in a heating, ventilation, and air conditioning (HVAC) system, the HVAC system further comprising a flash tank configured to receive two-phase refrigerant from a condenser and a first expansion valve disposed between the condenser and an inlet of the flash tank, wherein the pressure sensor is configured to measure a pressure of liquid refrigerant in the flash tank;

determining, based on the first pressure measurement, that a liquid refrigerant level within the flash tank is below a threshold height; and opening the first expansion valve to provide additional refrigerant to the flash tank.

9. The method of claim 8, further comprising:

receiving a second pressure measurement from the pressure sensor;

determining, based on the second pressure measurement, that the liquid refrigerant level within the flash tank is above the threshold height; and closing the first expansion valve to prevent additional refrigerant from being supplied to the flash tank.

10. The method of claim 8, wherein the pressure sensor is a differential pressure sensor configured to measure a pressure difference between the inlet of the flash tank and a base of the flash tank.

11. The method of claim 8, wherein the pressure sensor is a first absolute pressure sensor disposed at a base of a liquid refrigerant within the flash tank.

12. The method of claim 11, further comprising receiving an additional pressure measurement from an additional absolute pressure sensor disposed at a different location within the flash tank than the first absolute pressure sensor.

13. The method of claim 8, wherein the flash tank is further configured to separate the two-phase refrigerant into a liquid refrigerant and a gaseous refrigerant, wherein the liquid refrigerant is provided to an evaporator and the gaseous refrigerant is provided to a compressor.

14. The method of claim 8, further comprising:

reducing, by the first expansion valve, a first pressure of refrigerant received from the condenser to a second pressure; and reducing, by a second expansion valve disposed between the flash tank and an evaporator, a third pressure of refrigerant received from the flash tank to a fourth pressure.

15. A non-transitory computer-readable medium storing computer-executable instructions, that when executed by one or more processors, cause the one or more processors to:

receive a first pressure measurement from a pressure sensor provided in a heating, ventilation, and air conditioning (HVAC) system, the HVAC system further comprising a flash tank configured to receive two-phase refrigerant from a condenser and a first expansion valve disposed between the condenser and an inlet of the flash tank, wherein the pressure sensor is configured to measure a pressure of liquid refrigerant in the flash tank;

determine, based on the first pressure measurement, that a liquid refrigerant level within the flash tank is below a threshold height; and open the first expansion valve to provide additional refrigerant to the flash tank.

16. The non-transitory computer-readable medium of claim 15, wherein the computer-executable instructions cause the one or more processors to:

receive a second pressure measurement from the pressure sensor;

determine, based on the second pressure measurement, that the liquid refrigerant level within the flash tank is above the threshold height; and close the first expansion valve to prevent additional refrigerant from being supplied to the flash tank.

17. The non-transitory computer-readable medium of claim 15, wherein the pressure sensor is a differential pressure sensor configured to measure a pressure difference between the inlet of the flash tank and a base of the flash tank.

18. The non-transitory computer-readable medium of claim 15, wherein the pressure sensor is a first absolute pressure sensor disposed at a base of a liquid refrigerant within the flash tank.

19. The non-transitory computer-readable medium of claim 18, wherein the computer-executable instructions cause the one or more processors to:

receive an additional pressure measurement from an additional absolute pressure sensor disposed at a different location within the flash tank than the first absolute pressure sensor.

20. The non-transitory computer-readable medium of claim 15, wherein the flash tank is further configured to separate the two-phase refrigerant into a liquid refrigerant and a gaseous refrigerant, wherein the liquid refrigerant is provided to an evaporator and the gaseous refrigerant is provided to a compressor.

* * * * *